US009665042B2

(12) United States Patent
Murayama

(10) Patent No.: US 9,665,042 B2
(45) Date of Patent: May 30, 2017

(54) IMAGE FORMING APPARATUS FORMING MARKS FOR CORRECTING DEVIATION IN PRINTING POSITION

(71) Applicant: Kentaro Murayama, Kasugai (JP)

(72) Inventor: Kentaro Murayama, Kasugai (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 0 days.

(21) Appl. No.: 13/852,256

(22) Filed: Mar. 28, 2013

(65) Prior Publication Data

US 2013/0322904 A1 Dec. 5, 2013

(30) Foreign Application Priority Data

May 31, 2012 (JP) ..... 2012-125054

(51) Int. Cl.

*G03G 15/16* (2006.01)
*G03G 15/01* (2006.01)
*G03G 15/00* (2006.01)

(52) U.S. Cl.

CPC ..... *G03G 15/16* (2013.01); *G03G 15/0194* (2013.01); *G03G 15/5058* (2013.01); *G03G 2215/0158* (2013.01)

(58) Field of Classification Search

CPC ..... G03G 15/5058; G03G 2215/0161; G03G 15/0194
USPC ..... 399/44, 49, 72
See application file for complete search history.

(56) References Cited

U.S. PATENT DOCUMENTS

2003/0052958 A1* 3/2003 Shinohara ..... G03G 15/5058 347/116
2006/0153603 A1* 7/2006 Nishikawa et al. ..... 399/301
2008/0019740 A1* 1/2008 Oouchi ..... G03G 15/0131 399/301
2008/0226361 A1* 9/2008 Tomita et al. ..... 399/301
(Continued)

FOREIGN PATENT DOCUMENTS

JP 63-279275 A 11/1988
JP 2003-098793 A 4/2003
(Continued)

OTHER PUBLICATIONS

Mar. 8, 2016—(JP) Notice of Reasons for Rejection—Application No. 2012-125054.

*Primary Examiner* — Walter L Lindsay, Jr.
*Assistant Examiner* — Philip Marcus T Fadul
(74) *Attorney, Agent, or Firm* — Banner & Witcoff, Ltd.

(57) ABSTRACT

An image forming apparatus includes an image forming device, a print object moving device configured to move a print object in a moving direction relatively to the image forming device, a detector configured to detect images formed on the print object, and a control device configured to control the image forming device to form a first plurality of marks and a second plurality of marks on the print object. The first marks are along the moving direction and the second marks are along the moving direction and to be away from the first marks in a width direction that is perpendicular to the moving direction and the second marks are smaller in number than the first marks. The control device is further configured to control the detector to detect the first marks and the second marks on the print object for detecting deviation in image forming positions.

5 Claims, 14 Drawing Sheets

(56) References Cited

U.S. PATENT DOCUMENTS

| | | | | |
|---|---|---|---|---|
| 2009/0196636 | A1* | 8/2009 | Miyadera | 399/39 |
| 2011/0158670 | A1* | 6/2011 | Fuchimoto | 399/66 |
| 2013/0148996 | A1* | 6/2013 | Masui | 399/72 |

FOREIGN PATENT DOCUMENTS

| | | | |
|---|---|---|---|
| JP | 2004-333837 | A | 11/2004 |
| JP | 2005084543 | A | 3/2005 |
| JP | 2007-241079 | A | 9/2007 |
| JP | 2007-298868 | A | 11/2007 |
| JP | 2008-003396 | A | 1/2008 |
| JP | 2008-026639 | A | 2/2008 |
| JP | 2009-015349 | A | 1/2009 |

* cited by examiner

IMAGE FORMING APPARATUS FORMING MARKS FOR CORRECTING DEVIATION IN PRINTING POSITION

CROSS REFERENCE TO RELATED APPLICATION

The present application claims priority from Japanese Patent Application No. 2012-125054 filed on May 31, 2012, which is incorporated herein by reference.

TECHNICAL FIELD

The present disclosure relates to a technique for reducing consumption of a coloring agent in an image forming apparatus that corrects deviation in the image forming positions of image data and forms an image.

BACKGROUND

It is known that an image forming apparatus forms marks on a moving transfer belt with using toner and the marks are detected to detect a deviation in relative positions of the transfer belt and a photosensitive drum. The marks are formed on the transfer belt by the photosensitive drum. Marks are repeatedly formed on the transfer belt along the moving direction of the transfer belt. Accordingly, a mark group extending in the moving direction of the transfer belt is formed. A plurality of mark groups are provided to overlap with each other in a width direction that is perpendicular to the moving direction. The mark groups are detected to detect the deviation in printing positions.

According to the technology, relative deviation in positions of the transfer belt and the photosensitive drum in the moving direction is detected by using the mark groups formed along the moving direction of the transfer belt. Relative deviation in positions of the transfer belt and the photosensitive drum in the width direction is detected by using the mark groups formed to overlap with each other in the width direction of the transfer belt.

SUMMARY

The marks are formed on a print object such as a transfer belt and the relative deviation in positions of the print object and a forming device including a photosensitive drum is detected according to detection of the marks. Deviation in image forming positions of image data is corrected based on the detection result of the relative deviation in positions of the print object and the forming device. Such a technology is useful for forming images precisely. The coloring agent such as toner is used in forming the marks on the print object. In the above technology, the mark groups are formed along an almost entire length of the transfer belt, and this increases the amount of the coloring agent to be used.

According to the present technology, an image forming apparatus includes an image forming device configured to form images with an image forming agent on a print object, a print object moving device configured to move the print object in a moving direction relatively to the image forming device, a detector configured to detect the images, and a control device configured to control the image forming device to form an image including a first plurality of marks on the print object, the first plurality of marks being along the moving direction, control the image forming device to form an image including a second plurality of marks on the print object, the second plurality of marks being along the moving direction and to be away from the first plurality of marks in a width direction that is perpendicular to the moving direction, the second plurality of marks being smaller in number than the first plurality of marks, and control the detector to detect the first plurality of marks and the second plurality of marks on the print object for detecting deviation in image forming positions.

DETAILED DESCRIPTION OF THE ILLUSTRATIVE ASPECTS

<First Illustrative Aspect>

A first illustrative aspect will be hereinafter explained with reference to FIGS. 1 to 12.

1. Mechanical Construction of Printer

Figure 1:
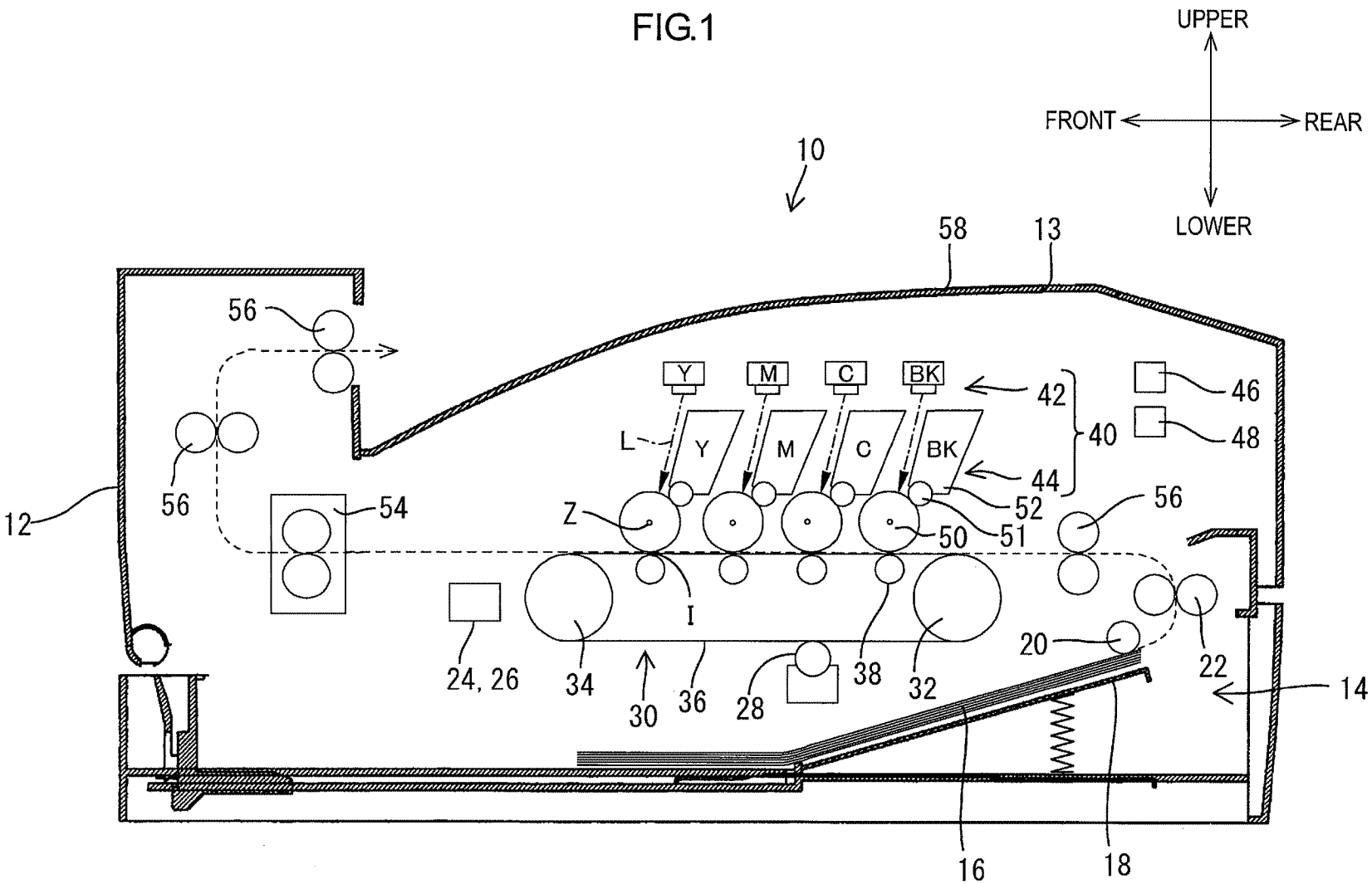
FIG. 1 is a cross-sectional view illustrating a printer.

As illustrated in FIG. 1, a printer 10 is a color laser printer of a direct-transfer tandem type that forms color images with using toner of four colors including yellow, magenta, cyan, and black. The printer 10 includes a casing 12, and a supply tray 14 is provided in an inner bottom portion of the casing 12. A sheet material 16 (one of examples of a print object) 16 such as papers is stacked in the supply tray 14. The toner is one of examples of an image forming agent.

The sheet material 16 is put in the supply tray 14 and the supply tray 14 is put into the casing 12 by a user. Then, the sheet material 16 is lifted up by a pressing plate 18 so as to be held between a pick-up roller 20 and the pressing plate 18. The sheet material 16 is transferred to resist rollers 22 by rotation of the pick-up roller 20. After inclination of the sheet material 16 is corrected to be straight by the resist rollers 22, the sheet material 16 is transferred to a belt unit 30 and an image forming unit 40.

The belt unit 30 includes a pair of support rollers 32, 34, a belt 36 (another one of examples of the print object), and a plurality of transfer rollers 38. The belt 36 is arranged between the support rollers 32, 34 and two ends of the belt 36 are connected to form a ring shape. The transfer rollers 38 are arranged on an inner side of the ring-shaped belt 36 at equal intervals. The support rollers 32, 34 are rotated in a counterclockwise direction by a motor (not illustrated) and this moves the belt 36 so as to be rotated around the support rollers 32, 34. The sheet material 16 transferred to the belt unit 30 moves with the belt 36 according to the rotational movement of the belt 36.

The image forming unit 40 is provided above the belt unit 30. The image forming unit 40 includes scanner devices 42 and process devices 44. Four scanner devices 42 are provided corresponding to four colors of toner, and four process devices 44 are provided corresponding to four colors of toner. To specify each of the scanner devices 42 or the process devices 44, one of Y (yellow), M (magenta), C (cyan) and BK (black) is applied to the corresponding reference numeral. Each process device 44 is arranged to correspond to each transfer roller 38 at equal intervals. Each scanner device 42 is arranged above the corresponding process device 44. Each scanner device 42 and the corresponding process device 44 configure one of examples of an image forming device.

The image forming unit 40 includes the scanner devices 42 and the process devices 44. Each process device 44 includes a photosensitive drum 50 and a development cartridge 52. A cover 13 provided in an upper portion of the casing 12 is open so that each process device 44 is capable of exchanged with new one. The development cartridge 52 is filled with toner and provided with a development roller 51. In the development cartridge 52, a development bias is applied to the development roller 51 from a high-pressure power source (not illustrated). The photosensitive drum 50 is one of examples of an image supply device.

The scanner devices 42 are mounted to the cover 13 and each scanner device 42 is arranged above the photosensitive drum 50 of the corresponding process device 44. The scanner device 42 irradiate the photosensitive drum 50 of the process device 44 with light ray L according to image data that is sent from a memory 64 such as a RAM or a ROM by a central processing unit 62 (see FIG. 2, hereinafter referred to as a CPU). Accordingly, an electrostatic latent image is formed on a surface of the photosensitive drum 50. Toner stored in the development cartridge 52 is supplied to the electrostatic latent image formed on the surface of the photosensitive drum 50 and accordingly, a toner image is formed on the surface of the photosensitive drum 50.

The photosensitive drum 50 is rotated around an axis Z according to the movement of the belt 36. When the toner image formed on the surface of the photosensitive drum 50 passes by a transfer position I in which the photosensitive drum 50 faces and is contact with the belt 36, a transfer bias is applied to the transfer roller 38 from the high-pressure power source. Accordingly, the toner image formed on the photosensitive drum 50 is transferred onto the sheet material 16 or the belt 36. As a result, an image is formed on the sheet material 16 or mark groups 92, 94 including marks X are formed on the belt 36 (refer to FIG. 3). According to the movement of the sheet material 16 or the belt 36, images of each color are continuously formed on the sheet material 16 and the marks of each color are continuously formed on the belt 36. The sheet material 16 having the image thereon is transferred to a fixing device 54 and the image is fixed to the sheet material 16 by the fixing device 54. Thereafter, the sheet material 16 is transferred by the transfer rollers 56 toward a discharge tray 58 that is provided outside of the casing 12.

A temperature sensor 46 and a humidity sensor 48 are provided adjacent to the development cartridge 52 of the image forming unit 40. The temperature sensor 46 measures temperature within the printer 10 and the humidity sensor 46 measures humidity within the printer 10. The temperature sensor 46 and the humidity sensor 48 are one of examples of a measurement device.

Optical sensors 24, 26 are provided on a front side of the belt unit 30. The optical sensors 24, 26 detect the marks of the mark groups 92, 94 that are formed on the belt 36. The optical sensors 24, 26 are reflection-type optical sensors and are arranged along a width direction of the belt 36 that is perpendicular to a moving direction of the belt 36 illustrated by an arrow 90. The optical sensors 24, 26 are an example of a detector.

A cleaning roller 28 is provided below the belt unit 30. The cleaning roller 28 removes toner or paper dust adhered to the belt 36. The cleaning roller 28 removes toner that is adhered to the belt unintentionally and also removes the marks that are intentionally formed on the belt 36.

2. Electric Configuration of Printer

Figure 2:
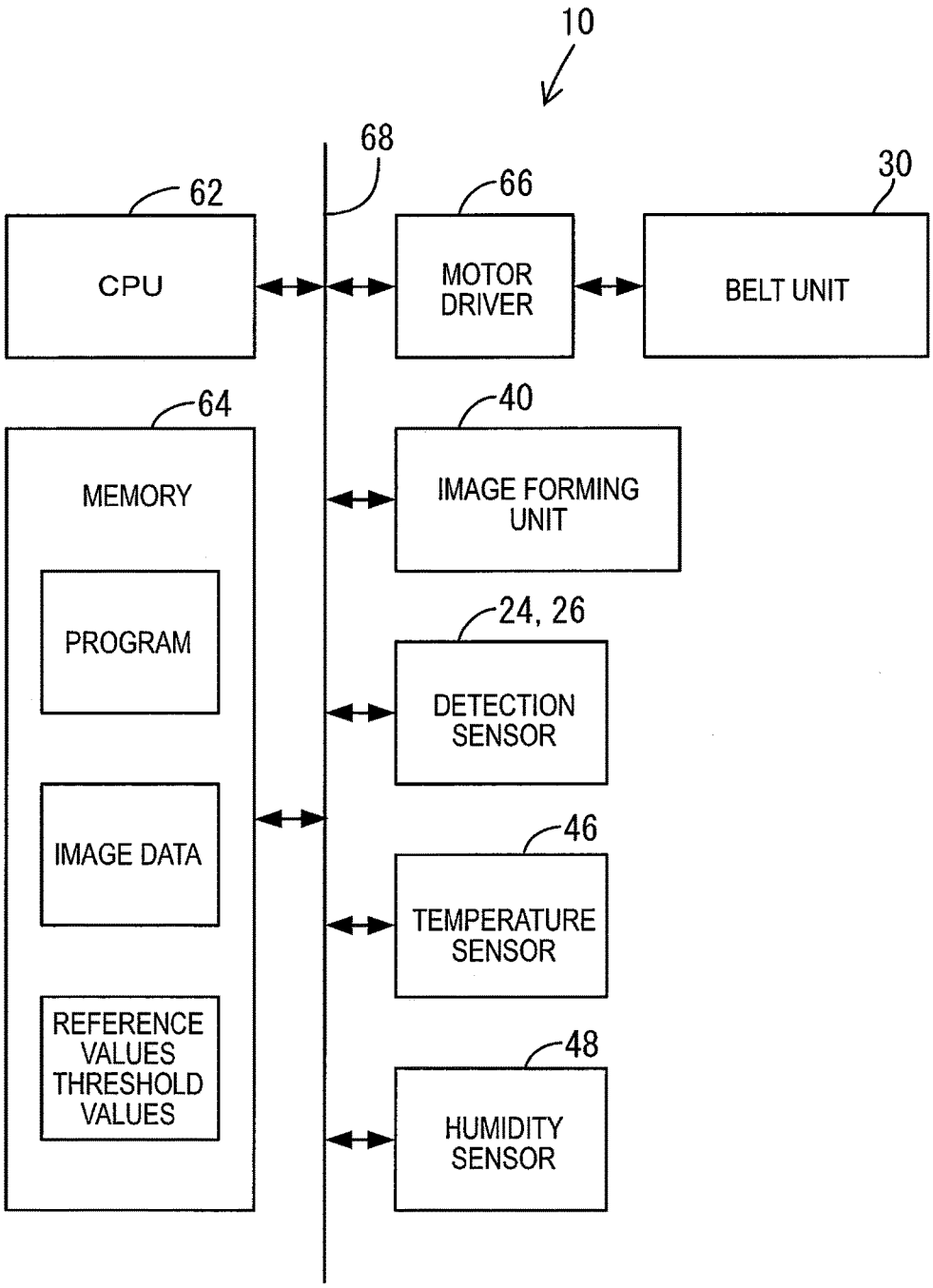
FIG. 2 is a block diagram illustrating the printer.

As illustrated in FIG. 2, the printer 10 mainly includes a CPU 62, a memory 64, and a motor driver 66. The CPU 62, the memory 64, and the motor driver 66 are connected to each other via a bus 68, and the image forming unit 40, the optical sensors 24, 26, the temperature sensor 46 and the humidity sensor 48 are connected thereto and each other via the bus 68. The CPU 62 is one of examples of a control device.

The memory 64 stores various programs that control an operation of the printer 10. The CPU 64 functions as the control device according to the program read from the memory 64 and executes control operations.

The motor driver 66 is connected to a motor (not illustrated) and sends a pulse signal to the motor based on a command from the CPU 62. The motor is driven and rotated by a rotation angle of one step by one pulse of the pulse signal. If the motor is driven by one step, the support rollers 32, 34 are driven to move the belt 36 of the belt unit 30.

3. Mark Group

In the printer 10, deviation in an image forming positions on the sheet material 16 may be caused between the four scanner devices 42 or between the four process devices 44 due to various reasons. For example, the scanner devices 42 may be inclined with respect to the belt moving direction of the belt 36 due to opening and closing of the cover 13. Also, the belt 36 is degraded due to its long use, and this may deform the belt 36 in its width direction that is perpendicular to the belt moving direction.

Figure 3:
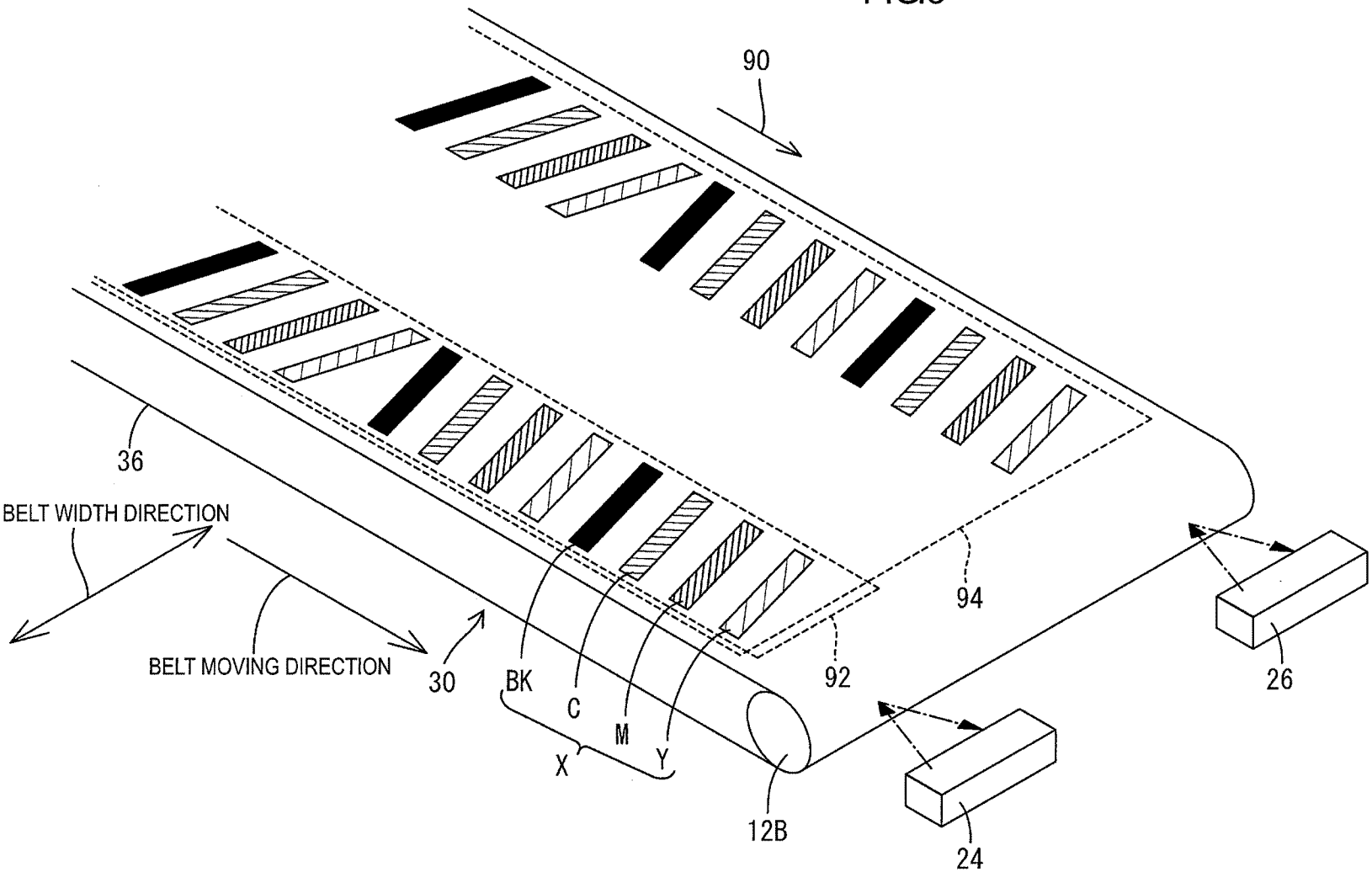
FIG. 3 is a perspective view illustrating optical sensors and a belt unit.

If deviation is caused in the image forming positions of the scanner devices 42 or the process devices 44, quality of images formed on the sheet material 16 is deteriorated. The memory 64 stores a program for correcting the image forming positions. The CPU 62 executes a correction process before forming images on the sheet material 16 or when forming images on the sheet material 16. The belt 36 is formed in an elongated shape and its longitudinal direction corresponds to the moving direction of the belt 36 and its short direction corresponds to the width direction of the belt 36, as illustrated in FIG. 3.

In the correction process, the CPU 62 controls each scanner device 42 and each process device 44 to form the marks on the belt 36. The sensors 24, 26 detect the marks and the CPU 62 corrects deviations in the image forming positions based on the detection result. Various mark group patterns that are formed in a process of detecting and correcting deviations in image forming positions will be explained. Examples of the mark groups that are formed in the detection and correction process are illustrated in FIGS. 7 to 10. In the detection and correction process, a first mark group 92, a second mark group 94, a third mark group 96, and a density detection mark group 98 are formed on the belt 36. In FIGS. 7 to 10, the belt 36 moves from a lower side to an upper side and the upper side is a belt downstream side and the lower side is a belt upstream side in movement of the belt 36.

Figure 7:
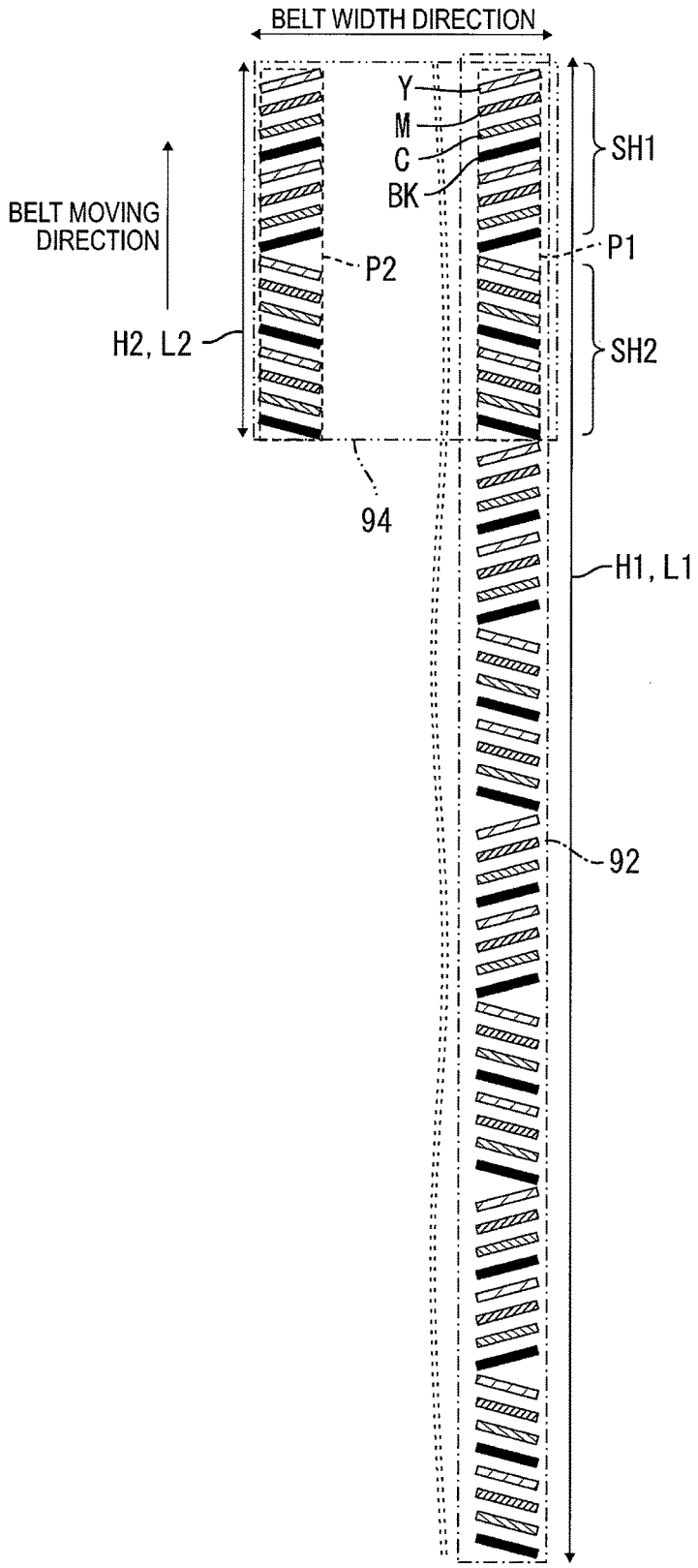
FIG. 7 illustrates mark groups of a pattern A.

The first mark group 92 will be explained with reference to a pattern A illustrated in FIG. 7 The first mark group 92 includes a plurality of marks X that are arranged along the belt longitudinal direction. As illustrated in FIG. 7, the marks X having a first inclination pattern SH1 are inclined to a right upward direction with respect to the short direction of the belt 36 and the marks X having a second inclination pattern SH2 are inclined to a right downward direction with respect to the short direction of the belt 36.

As illustrated in FIG. 7, in the first mark group 92, the marks X having the first inclination pattern SH1 are arranged from a yellow mark Y, a magenta mark M, a cyan mark C, and a black mark BK in this order from the upper side in FIG. 7 at substantially equal intervals. The marks of four colors Y, M, C, BK of the first inclination pattern SH1 form one set and two sets of the marks are arranged continuously. In the first mark group 92, the marks X having the second inclination pattern SH2 are arranged from a yellow mark Y, a magenta mark M, a cyan mark C, and a black mark BK in this order continuously from the last mark BK having the first inclination pattern SH1 in FIG. 7. The marks X having the second inclination pattern SH2 are arranged at substantially equal intervals. The marks of four colors Y, M, C, BK of the second inclination pattern SH2 form one set and two sets of the marks are arranged continuously.

Two sets of the marks of four colors Y, M, C, BK of the first inclination pattern SH1 and two sets of the marks of four colors Y, M, C, BK of the second inclination pattern SH2 form a patch P, as illustrated in FIG. 7.

Patches P are arranged along the belt longitudinal direction to form the first mark group 92. The first mark group 92 extends over a first range H1 in the belt longitudinal direction and has a length L1. The length L1 of the first mark group 92 is equal to an entire length of the belt 36.

The second mark group 94 will be explained with reference to the pattern A illustrated in FIG. 7. The second mark group 94 includes one P1 of the patches P included in the first mark group 92 and a patch P2 that is provided so as to correspond to and to be away from the one P1 of the patches P in the belt width direction, as illustrated in FIG. 7.

As illustrated in FIG. 7, a first patch P1 is included in the first mark group 92 and the second mark group 94. The second mark group 94 includes the first patch P1 and a second patch P2. The second patch P2 is away from and corresponds to the first patch P1 in the belt width direction.

The first mark group 92 includes the first patch P1 and the marks X of the first mark group 92 arranged along the belt longitudinal direction are greater in number than the marks X included in the first patch P1. The second mark group 94 includes the first patch P1 and the second patch P2. The second mark group 94 is formed over a second range H2 along the belt longitudinal direction having a length L2. The length L2 is equal to an entire outer circumferential length around an axis Z of the photosensitive drum 50.

The third mark group 96 will be explained with reference to a pattern B illustrated in FIG. 8B. The third mark group 96 is formed on the upstream side of the second patch P2 in the belt moving direction. In FIG. 8B, a patch P arranged on the upstream side from the first patch P1 in the belt moving direction is a fourth patch P4. The third mark group 96 is provided so as to correspond to and be away from the fourth patch P4 in the belt width direction. The third mark group 96 is formed in the first range H1 in the belt longitudinal direction. The third mark group 96 corresponds to a fifth patch P5.

The density detection mark groups 98, 98A, 98B will be explained with reference to FIGS. 8 to 10. As illustrated in FIGS. 8A, 8B, 10A and 10B, the density detection mark group 98 includes the rectangular marks X of the four colors of yellow, magenta, cyan and black. The marks of the four colors Y, M, C and BK are arranged in this order at substantially equal intervals. As illustrated in FIG. 9, a first density detection mark group 98A includes the marks of two colors Y and M, and a second density detection mark group 98B includes the marks of two colors C and BK, for example.

Each of the marks X included in the density detection mark groups 98, 98A, 98B has a length in the belt longitudinal direction that is greater than a length of each of the marks X included in the patch P. Therefore, the optical sensors 24, 26 detect the mark X of the density detection mark group 98, 98A, 98B and obtain greater amount of data related to the density from the density detection mark X than the position detection mark X included in the second patch P2 for example.

In the detection and correction process, at least the first mark group 92 is formed on the belt 36. Deviation in print positions in the belt longitudinal direction is detected by using the first mark group 92 and the positions of the images in the belt longitudinal direction formed by the scanner devices 42 and the process devices 44 are corrected based on the detected deviation. The second mark group 94 or the third mark group 96 is formed in addition to the first mark group 92 and accordingly, deviation in print positions in the belt width direction is detected and the positions of the images in the belt width direction formed by the scanner devices 42 and the process devices 44 are corrected based on the detected deviation. In the detection and correction process, the density detection mark group 98, 98A, 98B is additionally formed. Accordingly, the density of images formed by the scanner devices 42 and the process devices 44 is detected and corrected based on the detection result.

4. Detection and Correction Process

The detection and correction process for detecting and correcting deviation in positions such as image forming positions will be explained with reference to FIG. 4.

The CPU 62 starts the detection and correction process and determines to form the first mark group 92. The CPU 62 determines whether the cover 13 is opened and closed after a previous detection and correction process (S2). If determining that the cover 13 is opened and closed (S2:YES), the CPU 62 determines to form the second mark group 94 in addition to the first mark group 92 (S4). Due to the opening and closing of the cover 13, each of the scanner devices 42 may be tilted. Therefore, the first mark group 92 and the second mark group 94 are formed to detect and correct deviation in image forming positions in the belt width direction and the belt longitudinal direction.

If determining that the cover 13 is not opened and closed (S2:NO), the CPU 62 determines not to form the second mark group 94 (S6), and the deviation in image forming positions in the belt width direction is not detected and corrected.

The CPU 62 detects deviation in image forming positions in the belt longitudinal direction by using the first mark group 92 and corrects the deviation in image forming positions based on the detection result (S7) and terminates the detection and correction process. If detecting the deviation in image forming positions in the belt longitudinal direction, the CPU 62 hastens timing of forming images by the scanner devices 42 and the process devices 44.

Next, the CPU 62 detects temperature and humidity in the printer 10 according to detection results of the temperature sensor 46 and the humidity sensor 48. The CPU 62 calculates difference between the current detected values and the previous detected values of temperature and humidity and obtains change values. Then, the CPU 62 compares the obtained change values of temperature and humidity and an environmental change threshold value KS1 and determines whether each of the obtained change values is greater than the environmental change threshold value KS1 (S8).

If determining that the obtained change values of temperature and humidity are greater than the environmental change threshold value KS1 (S8:YES), the CPU 62 determines to form the first mark group 92, the second mark group 94, and the density detection mark group 98. If the change values of temperature and humidity are greater than the environmental change threshold value KS1, the density of images formed by the process devices 44 are likely to change. Therefore, the density is required to be detected and corrected.

It is determined whether the density is required to be corrected based on the environmental change threshold value KS1. Based on the environmental change threshold value KS1, it is determined whether the temperature or the humidity changes such that precision of the correcting the deviation in image forming positions is not ensured without executing the density correction prior to correcting the deviation in the image forming positions.

The CPU 62 detects a residual amount of toner in the development cartridge 52 of each process device 44 based on a detected value and determines whether the detected residual amount of toner is greater than a residual amount threshold value ZS (S10). If determining that the detected residual amount toner is greater than the residual amount threshold value ZS (S10:YES), the CPU 62 executes the detection and correction process with using a pattern D illustrated in FIG. 10A (S14).

(Detection and Correction Process Using Pattern D)

Figure 10A:
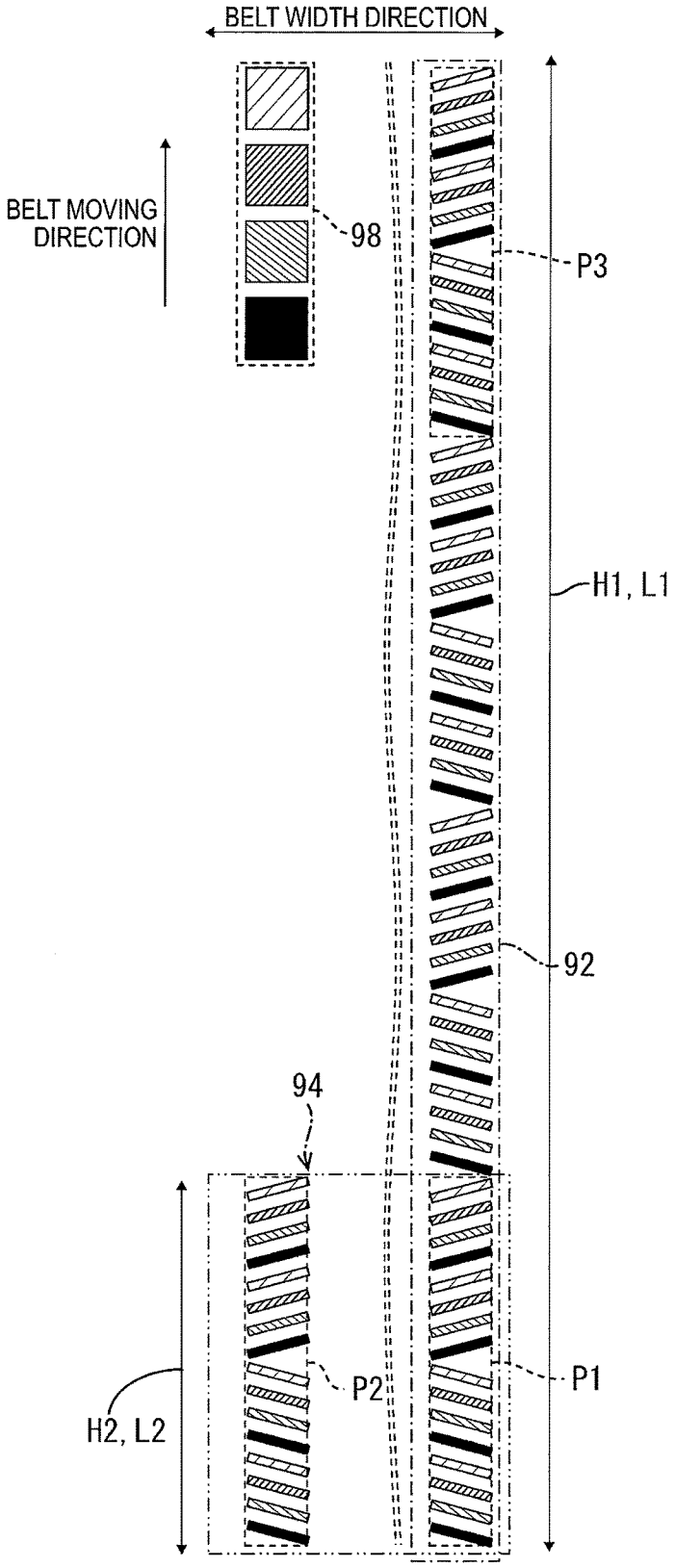
FIG. 10A illustrates mark groups of a pattern D.

As illustrated in FIG. 10A, the pattern D includes the first mark group 92, the second patch P2 and the density detection mark group 98. In the pattern D, the first mark group 92 is formed on one side of the belt 36 in the belt width direction and the density detection mark group 98 and the second patch P2 are formed on another side of the belt 36 in the belt width direction so as to be away from the first mark group 92. The density detection mark group 98 is provided on most downstream side in the belt moving direction within the first range H1 in the belt longitudinal direction. The second patch P2 is provided to correspond to the patch P1 that is provided on the most upstream side in the belt moving direction among the patches P included in the first mark group 92. The second patch P2 is provided away from the patch P1 in the belt width direction.

As illustrated in FIG. 10A, one of the patches P included in the first mark group 92 that is provided on the most upstream side in the belt moving direction is the first patch P1 and one of the patches P in the first mark group 92 that is provided on the most downstream side in the belt moving direction is a third patch P3. The second patch P2 of the second mark group 94 is provided on the most upstream side in the first range H1 in the belt moving direction and the density detection mark group 98 is provided on the downstream side of the second patch P2 in the belt moving direction.

The detection and correction process using the pattern D will be explained with reference to FIGS. 10A and 10B.

If starting the detection and correction process using the pattern D, the CPU 62 controls each scanner device 42 and each process device 44 to form the third patch P3 and the density detection mark group 98 on the belt 36. The CPU 62 detects the third patch P3 of the first mark group 92 and the density detection mark group 98 using the optical sensors 24, 26 and corrects the image density according to the density detection result obtained by detecting the density detection mark group 98 (S16).

The CPU 62 forms the patches of the first mark group 92 other than the third patch P3 and the second patch P2 based on the corrected density obtained in step S16. The second patch P2 and the patches of the first mark group 92 other than the third patch P3 are formed with the corrected density by the process devices 44.

In step S18, the CPU 62 detects deviation in image forming positions (a third patch positional deviation detection result) based on the third patch P3 among the patches P included in the first mark group 92. The third patch P3 is provided on the most downstream side in the belt moving direction. The CPU 62 executes a second mark group setting process starting from step S52 based on the third patch positional deviation detection result (S18). The third patch positional deviation detection result is one example of a first detection result.

In the second mark group setting process, the CPU 62 compares a reduction reference value KG stored in the memory 64 and the third patch positional deviation detection result (S52). The CPU 62 determines whether to reduce the number of marks X included in the second patch P2 that will be formed based on the reduction reference value KG. The third patch positional deviation detection result represents deviation in image forming positions in the belt longitudinal direction. As the deviation in positions of images formed by the scanner devices 42 and the process devices 44 in the belt longitudinal direction is greater, the third patch positional deviation detection result is also greater. As the deviation in image forming positions in the belt longitudinal direction is smaller, the third patch positional deviation detection result is also smaller.

If determining that the third patch positional deviation detection result is greater than the reduction reference value KG (S52:YES), the CPU 62 determines to form and forms the normal second patch P2 and the corresponding first patch P1 of the first mark group 92 with the corrected density (obtained in step S16) as illustrated in FIG. 10A (S54). If the third patch positional deviation detection result is greater than the reduction reference value KG, the deviation in image forming positions in the belt longitudinal direction is likely to be greater than a predetermined deviation. Therefore, the normal second patch P2 is formed to detect the positional deviation.

Figure 10B:
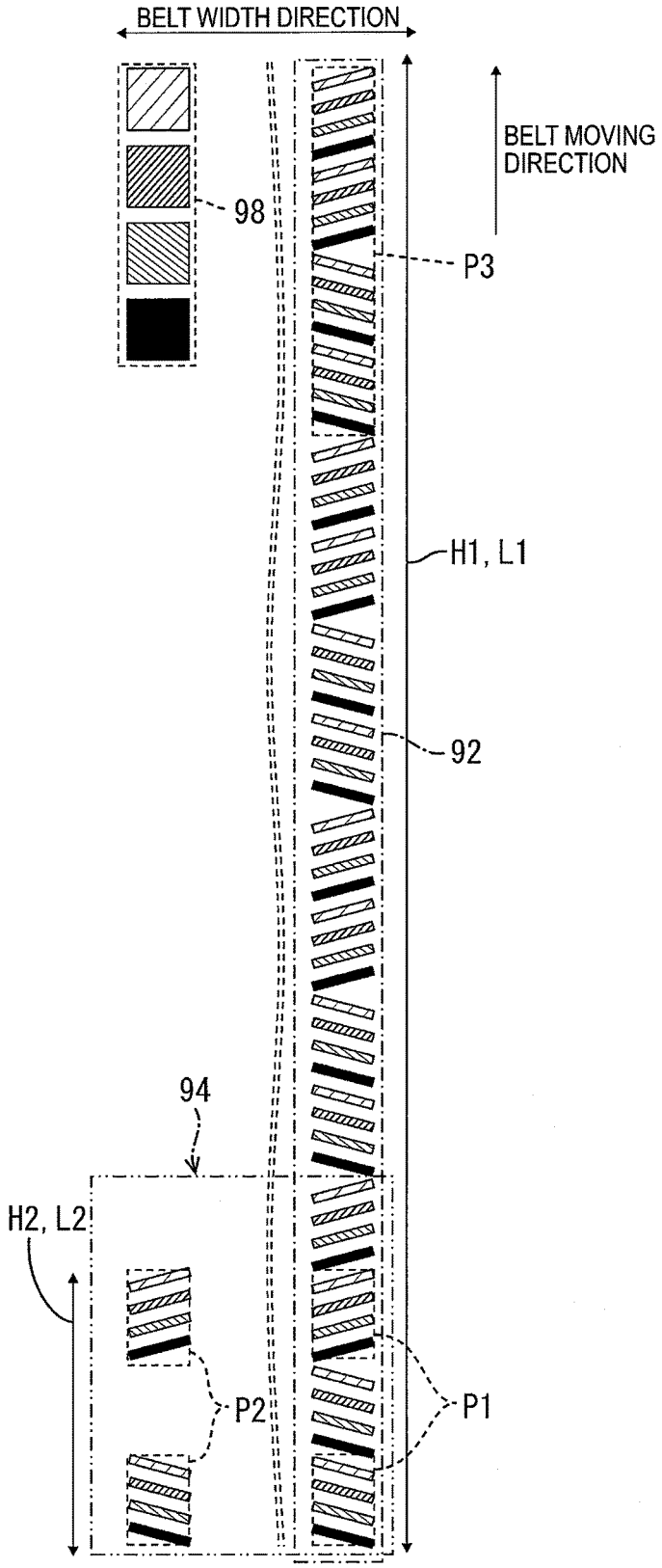
FIG. 10B illustrates mark groups of a pattern D.

If determining that the third patch positional deviation detection result is equal to or smaller than the reduction reference value KG (S52:NO), the CPU 62 determines to form and forms a second patch P2 with reduced number of marks X in the belt longitudinal direction and the corresponding first patch P1 of the first mark group 92 with the corrected density (obtained in step S16) as illustrated in FIG. 10B (S56). If the third patch positional deviation detection result is smaller than the reduction reference value KG, the deviation in image forming positions in the belt longitudinal direction is likely to be smaller than the predetermined deviation. Therefore, the second patch P2 with reduced number of marks X is formed to detect the positional deviation.

As illustrated in FIG. 10B, the reduced number second patch P2 includes one set of the marks X of four colors having the first inclination pattern SH1 and one set of the marks X of four colors having the second inclination pattern SH2. Therefore, the consumed amount of toner is reduced compared to the case in which the normal second patch P2 is formed.

The CPU 62 detects the first mark group 92 and the second mark group 94 or using the optical sensors 24, 26. The CPU 62 corrects the image forming positions in the belt longitudinal direction according to a first mark group detection result obtained by the detection of the first mark group 92. The CPU 62 corrects the image forming positions in the belt width direction according to a second mark group detection result obtained by the detection of the second mark group 94 (S20) and terminates the detection and correction process.

If the image forming position is deviated in the belt width direction that is the main scanning direction, a position of the process device 44 on which light beam L from the corresponding scanner device 42 is irradiated is shifted in a direction opposite to the main scanning direction. For example, if each scanner device 42 includes a plurality of LEDs that are arranged in the main scanning direction, the LED that emits light is changed to the one that is provided on the main scanning direction side. The second mark group detection result is one example of a second detection result.

(Detection and Correction Process Using Pattern C)

In step S10, if determining that the detected toner residual amount is equal to or less than the residual amount threshold value ZS (S10:NO), the CPU 62 executes the detection and correction process using the pattern C illustrated in FIG. 9 (S22).

As illustrated in FIG. 9, the pattern C includes the first mark group 92, the second mark group 94, a first density detection mark group 98A and a second density detection mark group 98B. In the pattern C, the second patch P2 is provided to correspond to one of the patches P included in the first mark group 92, and the one of the patches P is located at the second one or its succeeding one from the downstream side in the belt moving direction. The second patch P2 is provided away from the one of the patches P included in the first mark group 92 in the belt width direction.

The first density detection mark group 98A is provided on the downstream side of the second patch P2 in the belt moving direction and the second density detection mark group 98B is provided on the upstream side of the second patch P2 in the belt moving direction. The first density detection mark group 98A and the second density mark group 98B are examples of a density detection mark.

Starting the detection and correction process using the pattern C, in step S24, the CPU 62 determines whether each of the process devices 44 forms an image whose density is likely to change due to the change of temperature and humidity based on the change value of temperature and humidity obtained in step S8. If image forming conditions of each process device 44 changes due to the change in temperature and humidity, the toner supply amount changes and the image density may change even if images are formed with applying same bias. The memory 64 stores the environmental change threshold value KS1 and density change threshold values NS1, NS2, NS3, NS4 of each of the process devices 44 for the four colors.

If starting the detection and correction process using the pattern C, the CPU 62 compares the obtained change value of temperature and humidity and each of the density change threshold values NS1, NS2, NS3, NS4 of the four colors. If determining that the change value is smaller than the density change threshold value NS1, NS2, NS3, NS4, the CPU 62 controls the process device 44 of the color corresponding to the determined density change threshold value to form the first density detection mark group 98A. The density of images that are formed by the process device 44 whose density change threshold value is greater than the change value is likely to change.

If determining that the change value is greater than the density change threshold value NS1, NS2, NS3, NS4, the CPU 62 controls the process device 44 of the color corresponding to the determined density change threshold value to form the second density detection mark group 98B. The density of images that are formed by the process device 44 whose density change threshold value is smaller than the change value is less likely to change.

If the CPU 62 determines that the determinations are executed for all of the process devices 44, the third patch P3 and the first density detection mark group 98A are formed on the belt 36.

As illustrated in FIG. 9, the first density detection mark group 98A is formed first by using the process device 44 that is determined to form an image whose density is likely to change. The CPU 62 detects the first density detection mark group 98A using the optical sensors 24, 26 and corrects the density of images formed by the corresponding process device 44 based on the density detection result regarding the density detection mark group 98A (S26).

Hereafter, the CPU 62 forms the second patch P2 and the patches P in the first mark group 92 other than the third patch P3 at the corrected density. Therefore, the second patch P2 and the patches P in the first mark group 92 other than the third patch P3 are formed by the corresponding process device 44 at the corrected density. Namely, the image of the color that is determined to be likely to change its density is formed at the corrected density. The image of the color that is determined to be less likely to change its density, or the image of the color that is determined to form the second density detection mark group 98B is formed by the corresponding process device 44 at an original density that is a density before being corrected in step S26.

After forming the first patch P1 and the second patch P2, the CPU 62 detects the first patch P1 and the second patch P2 by using the optical sensors 24, 26 and corrects the image forming positions in the belt width direction according to the first patch detection result and the second patch detection result (S28). The CPU 62 executes a density pattern setting process (S30). In the density pattern setting process, a width of the second density detection mark group 98B and a position in the belt width direction in which the second density detection mark group 98B is formed are determined. The second density detection mark group 98B is formed by using the process device 44 that is determined to form an image whose density is less likely to change.

After correcting the image forming positions in the belt width direction, the CPU 62 checks image forming positions in the belt width direction. Therefore, when the CPU 62 controls to form the second density detection mark group 98B, it is not necessary to consider deviation in image forming positions in the belt width direction and to widen the second density detection mark group 98B. Therefore, the CPU 62 sets the width and the position of the second density detection mark group 98B in the belt width direction such that the width is reduced to the minimum possible size that is required to detect the density of the second density detection mark group 98B.

The CPU 62 continues forming the first mark group 92, and forms the second density detection mark group 98B on the belt 36 according to the position and the width determined in the density pattern setting process. The CPU 62 detects the first mark group 92 and the second density detection mark group 98B with using the optical sensors 24, 26. Then, the CPU 62 corrects image forming positions in the belt longitudinal direction based on the first mark group detection result and corrects the density of an image that is formed by the corresponding process device 44 based on the density detection result of the second density detection mark group 98B (S31). Then, the process is terminated.

Figure 4:
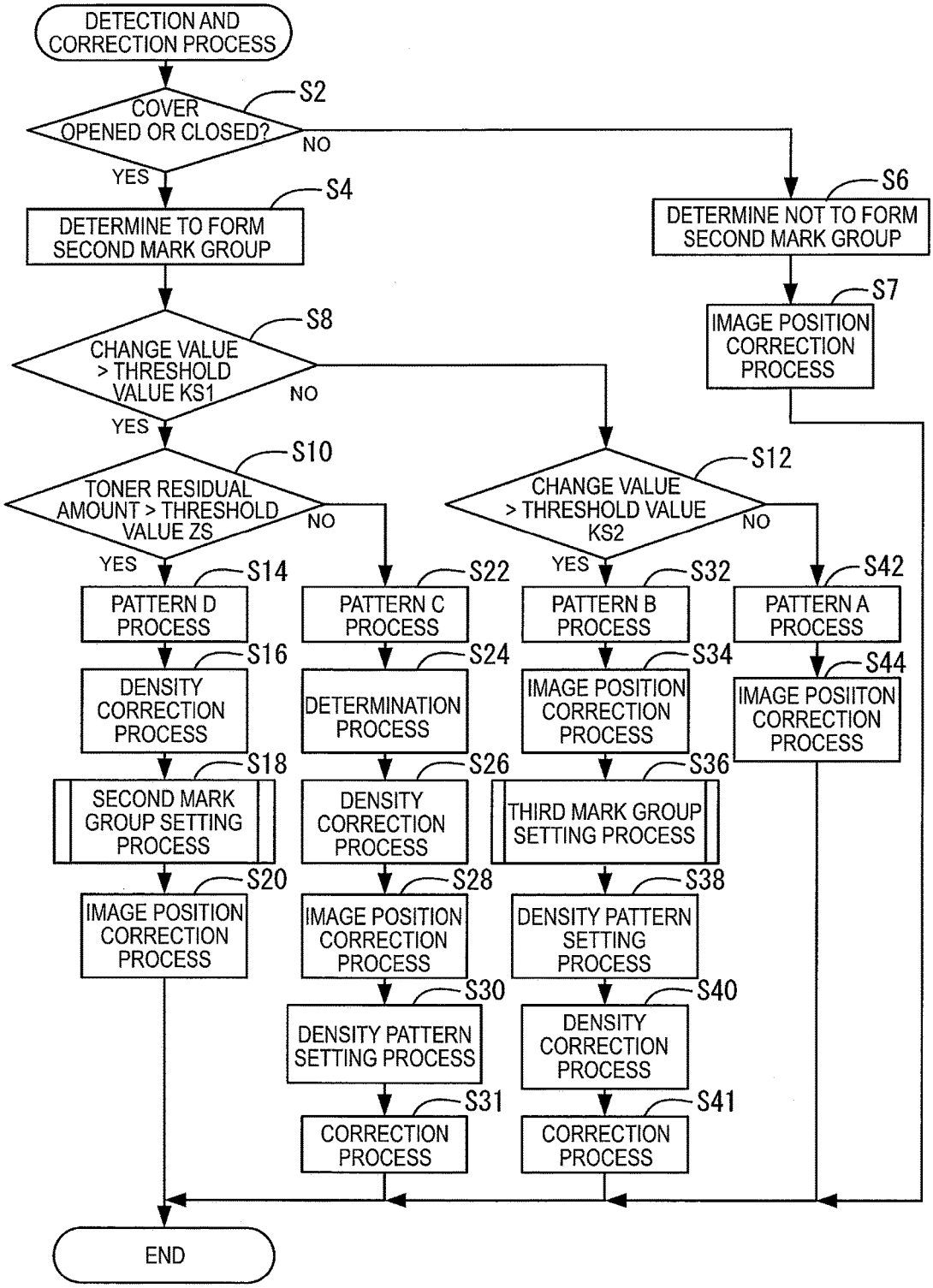
FIG. 4 is a flowchart illustrating a flowchart of a detection and correction process.
Figure 5:
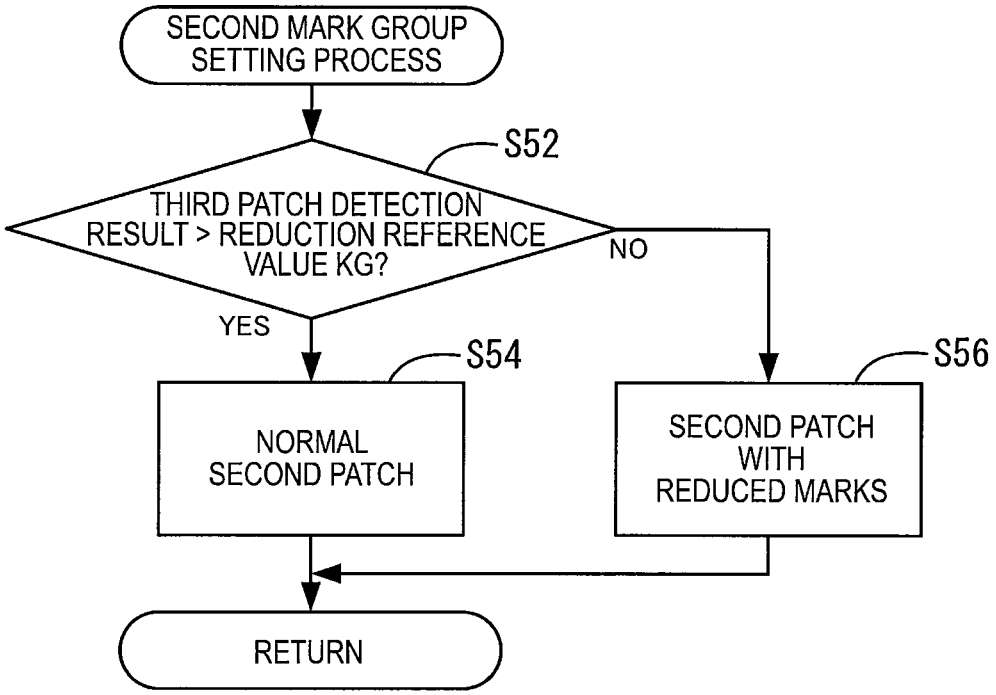
FIG. 5 is a flowchart illustrating a second mark group setting process.

In step S8 of FIG. 4, if determining that the change value of temperature and humidity is equal to or smaller than the environmental change threshold value KS1 (S8:NO), the CPU 62 determines to form the second patch P2 prior to the density detection mark group 98 and proceeds to step S12. If the change value of temperature and humidity is equal to or smaller than the environmental change threshold value KS1, the density of an image that is formed by each process device 44 is less likely to change.

In FIG. 4, the CPU 62 compares the change value of temperature and humidity obtained in step S8 and an environmental change threshold value KS2 that is set to be smaller than the environmental change threshold value KS1 and determines whether the change value of temperature and humidity is greater than the environmental change threshold value KS2 (S12).

The CPU 62 determines whether it is necessary to correct the density based on the environmental change threshold value KS2. More specifically, even if the precision of the correction in the image forming positions is ensured without correcting the density before correcting the image forming positions, the CPU 62 determines whether no density correction is required based on the environmental change threshold value KS2. If determining that the change value of temperature and humidity is greater than the environmental change threshold value KS2 (S12:YES), the CPU 62 executes a detection and correction process using a pattern B illustrated in FIG. 8A (S32).

(Detection and Correction Process Using Pattern B)

Figure 8A:
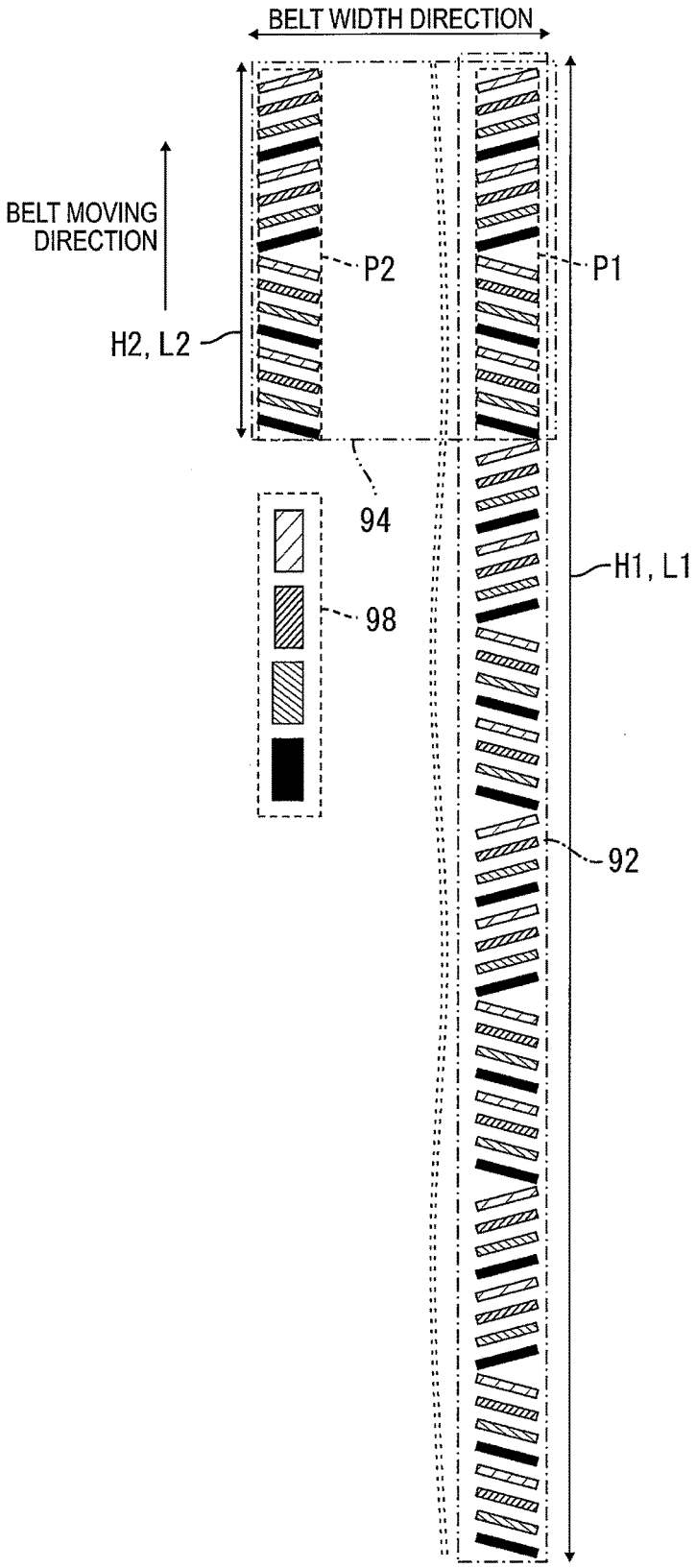
FIG. 8A illustrates mark groups of a pattern B.
Figure 8B:
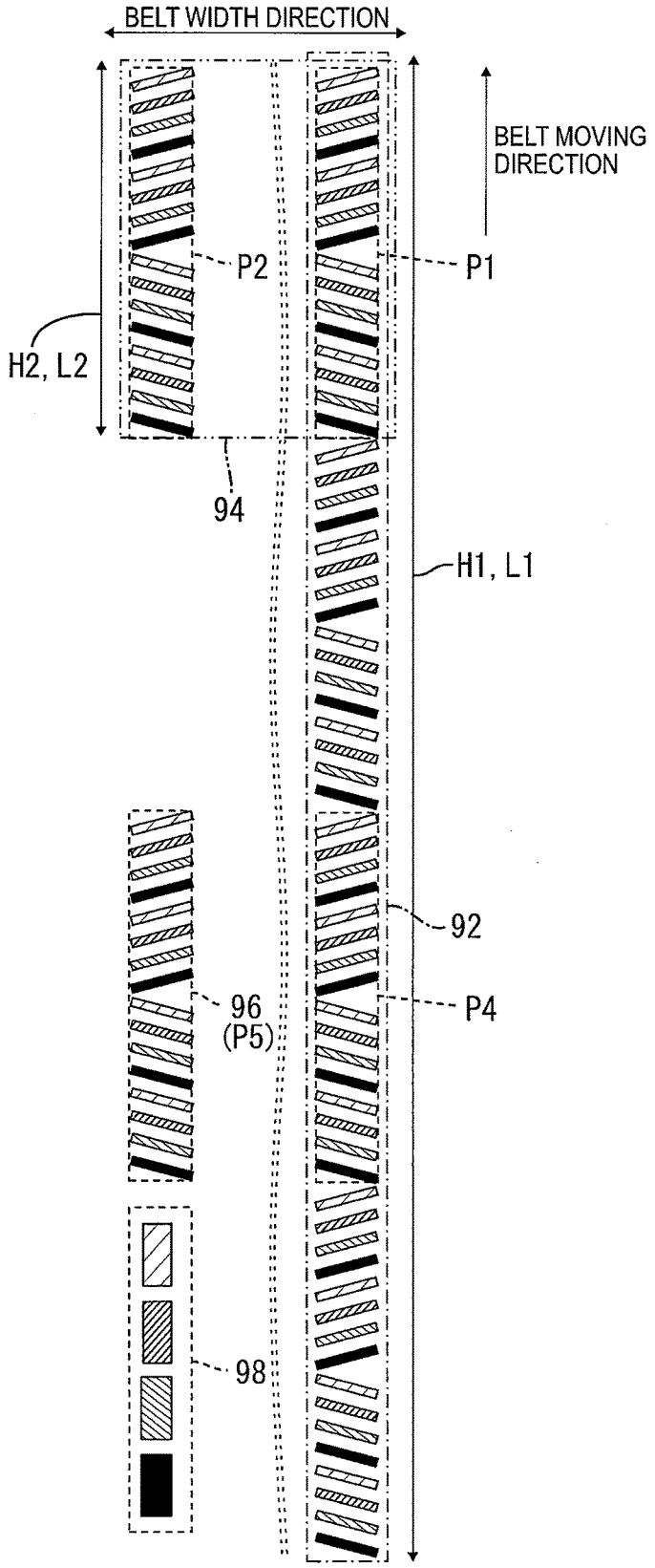
FIG. 8B illustrates mark groups of a pattern B.
Figure 9:
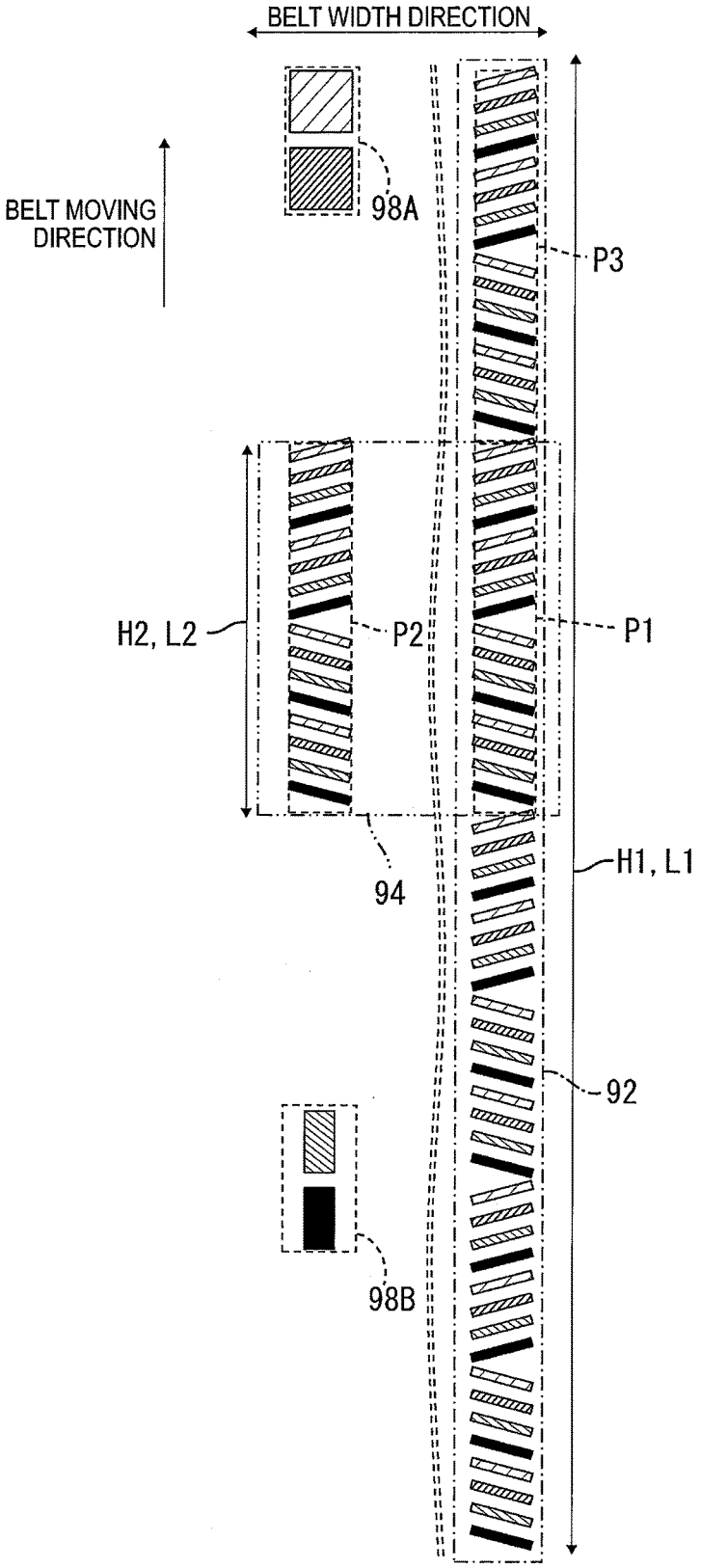
FIG. 9 illustrates mark groups of a pattern C.

As illustrated in FIGS. 8A and 8B, the pattern B includes the first mark group 92, the second patch P2 and the density detection mark group 98. In the pattern B, the second patch P2 is provided to correspond to the first patch P1 that is included in the first mark group 92 and provided on the most downstream side in the belt moving direction so as to be away from the first patch P1 in the belt width direction. The density detection mark group 98 is provided on the upstream side of the second patch P2 in the belt moving direction.

The detection and correction process using the pattern B will be explained with reference to FIGS. 8A and 8B. If starting the detection and correction process using the pattern B, the CPU 62 controls each scanner device 42 and each process device 44 to form the first patch P1 and the second patch P2 on the belt 36 and detects the first patch P1 and the second patch P2 with using the optical sensors 24, 26. The CPU 62 corrects image forming positions in the belt width direction according to the detection results of the first patch P1 and the second patch P2 (S34). The CPU 62 executes a third mark group setting process based on the detection results of the first patch P1 and the second patch P2 (S36).

Figure 6:
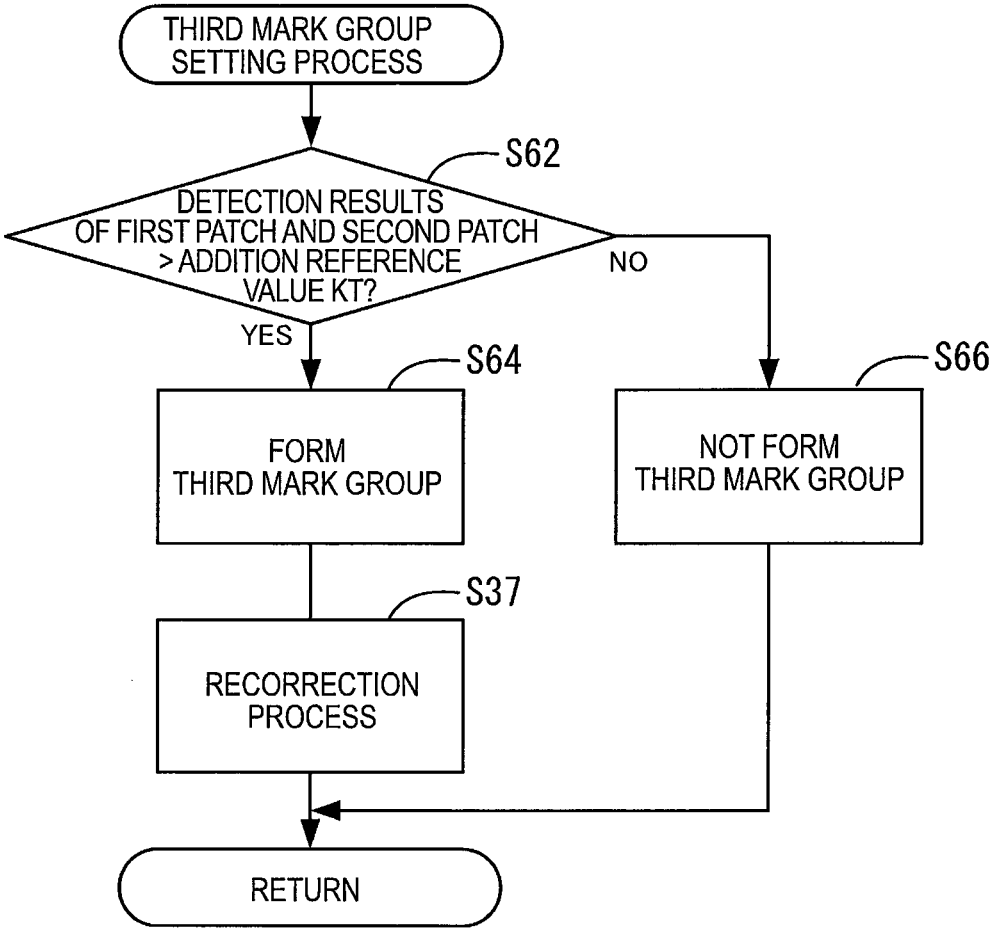
FIG. 6 is a flowchart illustrating a third mark group setting process.

As illustrated in FIG. 6, in the third mark group setting process, the CPU 62 compares an addition reference value KT stored in the memory 64 and a positional deviation in the belt width direction obtained by the detection results of the first patch P1 and the second patch P2 (S62). If determining that the positional deviation between the first patch P1 and the second patch P2 in the belt width direction is equal to or smaller than the addition reference value KT (S62:NO), the CPU 62 determines not to form the third mark group 96 as illustrated in FIG. 8A (S66). If the positional deviation between the first patch P1 and the second patch P2 in the belt width direction is equal to or smaller than the addition reference value KT, the positional deviation of the image forming positions in the belt width direction is not greater than a predetermined deviation value, and therefore, the third mark group 96 is not necessary to be formed to detect and correct the positional deviation in the belt width direction again.

If determining that the positional deviation between the first patch P1 and the second patch P2 in the belt width direction is greater than the addition reference value KT (S62:YES), the CPU 62 determines to form the third mark group 96 illustrated in FIG. 8B and forms the third mark group 96 (S64). If the positional deviation between the first patch P1 and the second patch P2 in the belt width direction is greater than the addition reference value KT, the positional deviation of the image forming positions in the belt width direction is greater than the predetermined deviation value, and therefore, the third mark group 96 is formed to detect and correct the positional deviation in the belt width direction again.

As illustrated in FIG. 8B, the third mark group 96 is provided to correspond to the fourth patch P4 that is located corresponding to the patch that is a third one in the first mark group 92 from the most downstream side in the belt moving direction. The third mark group 96 is provided to be away from the fourth patch P4 in the belt width direction and on the upstream side from the second patch P2 in the belt moving direction. The CPU 62 detects the fourth patch P4 and the third mark group 96 with using the optical sensors 24, 26 and corrects the image forming positions in the belt width direction again (S37).

After correcting the image forming positions in the belt width direction in step S37 or in determining not to form the third mark group 96 in step S66, the CPU 62 executes a density pattern setting process (S38). In the density pattern setting process, the CPU 62 sets a width and a position of the density detection mark group 98 in the belt width direction (S38). The CPU 62 continues forming the first mark group 92 and forms the density detection mark group 98 on the belt 36 according to the position and the width set in step S38. If the second patch P2 and the third mark group 96 are formed, the density detection mark group 98 is provided on the upstream side from the third mark group 96 in the belt moving direction and formed within the first range H1 in the belt longitudinal direction.

The CPU 62 detects the first mark group 92 and the density detection mark group 98 (S40). The CPU 62 corrects the image forming positions in the belt longitudinal direction based on the first mark group detection result corresponding to one round of the belt 36 and corrects the image density based on the density detection result (S41) and terminates the detection and correction process.

(Detection and Correction Process Using Pattern A)

In FIG. 4, if determining that the change value of temperature and humidity obtained in step S8 is equal to or smaller than the environmental change threshold value KS2 (S12:NO), the CPU 62 executes the detection and correction process using a pattern A in FIG. 7 (S42). If the change value of temperature and humidity is equal to or smaller than the environmental change threshold value KS2, the density of an image is less likely to change and therefore, it is not necessary to form the density detection mark group 98 and detect the image density. The pattern A includes the first mark group 92 and the second mark group 94 and the density detection mark group 98 is not formed in the pattern A.

The detection and correction process using the pattern A will be explained with reference to FIG. 7. If starting the detection and correction process using the pattern A, the CPU 62 controls each scanner device 42 and each process device 44 to form the first mark group 92 and the second mark group 94 on the belt 36 and detects the first mark group 92 and the second mark group 94 with using the optical sensors 24, 26. The CPU 62 corrects the image forming positions in the belt longitudinal direction according to the first mark group detection result and corrects the image forming positions in the belt width direction according to the second mark group detection result (S44) and terminates the detection and correction process.

5. Advantageous Effects of Illustrative Aspects (1) In the printer 10 according to the present illustrative aspect, the second mark group 94 is formed to detect and correct deviation in image forming positions. The length L2 of the second mark group 94 within the second range H2 in the belt longitudinal direction is shorter than the length L1 of the first mark group 92 within the first range h1 in the belt longitudinal direction. In the detection and correction process, two rows of the marks X are formed parallel to the belt longitudinal direction over the second range H2 and the marks X are not provided to overlap with each other in the belt width direction over the first range H1 that is longer than the second range H2. Therefore, compared to the related art in which the marks are provided to overlap with each other in the belt width direction over an entire length of the belt, the number of the marks X formed on the belt 36 is reduced. This reduces the consumption amount of toner.

(2) In the printer 10 according to the present illustrative aspect, in the detection and correction process using the pattern D, the second mark group 94 is formed after correcting the image density based on the density detection result. Therefore, deviation in image forming positions in the belt width direction is detected and corrected precisely by using the second mark group 94 whose image density is corrected.

(3) In the printer 10 according to the present illustrative aspect, in the detection and correction process using the pattern D, if it is determined that the third patch detection result is equal to or smaller than the reduction reference value KG, deviation in image forming positions in the belt longitudinal direction is less likely to occur. Accordingly, the number of marks X is reduced to form the second patch P2 and this reduces the consumption amount of toner that is used to form the second patch P2.

(4) In the printer 10 according to the present illustrative aspect, in the detection and correction process using the pattern C, if it is determined that the density of images that are formed by one of the process devices 44 is likely to change, the density of the images that are formed by the process device 44 is corrected with using the first density detection mark group 98A before forming the second mark group 94. The second mark group 94 is formed at a corrected density, and therefore, deviation in image forming positions in the belt width direction is precisely detected and corrected.

(5) In the printer 10 according to the present illustrative aspect, in the detection and correction process using the pattern C, the second mark group 94 is formed after correcting the image density based on the density detection result that is obtained by the detection of the first density detection mark group 98A. Therefore, deviation in image forming positions in the belt width direction is precisely detected and corrected with using the second mark group 94 whose image density is corrected. The width and the position of the second density detection mark group 98B in the belt width direction are determined based on the second mark group detection result. This reduces the consumption amount of toner used for forming the second density detection mark group 98B.

(6) In the printer 10 according to the present illustrative aspect, in the detection and correction process using the pattern B, if it is determined that the second mark group detection result is greater than the addition reference value KT, the third mark group 96 is formed and deviation in image forming positions in the belt width direction is detected and corrected again with using the fourth patch P4 and the third mark group 96. Accordingly, deviation in image forming positions in the belt width direction is precisely detected and corrected.

(7) In the printer 10 according to the present illustrative aspect, in the detection and correction process using the pattern B, the third mark group 96 is formed within the first range H1 in the belt longitudinal direction. The third mark group 96 is formed in a space provided on an upstream side of the second mark group 94.

(8) In the printer 10 according to the present illustrative aspect, in the detection and correction process using the pattern B, the density detection mark group 98 is formed in a space that is provided on the upstream side of the second patch P2 in the belt moving direction and adjacent to the first mark group 92 in the belt width direction. Thus, the density detection mark group is formed in the space.

(9) In the printer 10 according to the present illustrative aspect, in the detection and correction process using the pattern B, the width and the position of the density detection mark group 98 are determined based on the second mark group detection result. This reduces the consumption amount of toner used to form the density detection mark group.

The length of the second patch P2 in the belt moving direction is equal to a entire outer peripheral length of the photosensitive drum 50. With this configuration, the deviation in image forming positions that may be caused by rotation of the photosensitive drum 50 is detected according to detection of the second patch P2.

The length of the first range H1 in the belt moving direction is equal to an entire length of the belt 36 arranged in a loop. With this configuration, the deviation in image forming positions that may be caused by rotating movement of the belt 36 is detected according to detection of the first mark group.

<Other Illustrative Aspects>

The scope of the present invention is not limited to the illustrative aspects described above with reference to the drawings. The following illustrative aspects may be included in the technical scope of the present invention.

(1) The printer 10 is applied in the above illustrative aspect. However, it is not limited thereto. For example, a multifunctional device including a print function and at least one of a scan function, a copy function and a facsimile function may be used.

(2) In the above illustrative aspects, in the detection and correction process using the pattern D, if the third patch detection result is equal to or smaller than the reduction reference value KG, the number of the marks X included in the second patch P2 is reduced. However, the number of the marks X included in the first patch P1 may be reduced. The number of the marks X included in the first patch P1 and the second patch P2 may be reduced.

(3) In each of the patterns according to the above illustrative aspects, any one of the patches P included in the first mark group 92 may be the first patch P1. The positions of the second patch P2 and the density detection mark group 98 in the belt longitudinal direction may be changed if necessary. In the detection and correction process using the pattern A, the patch P provided on the most downstream side in the belt longitudinal direction in the first mark group 92 is the first patch P1 and the second mark group 94 is provided on the most downstream side in the belt moving direction within the first range H1 corresponding to the first patch P1. It is not limited thereto.

Figure 11:
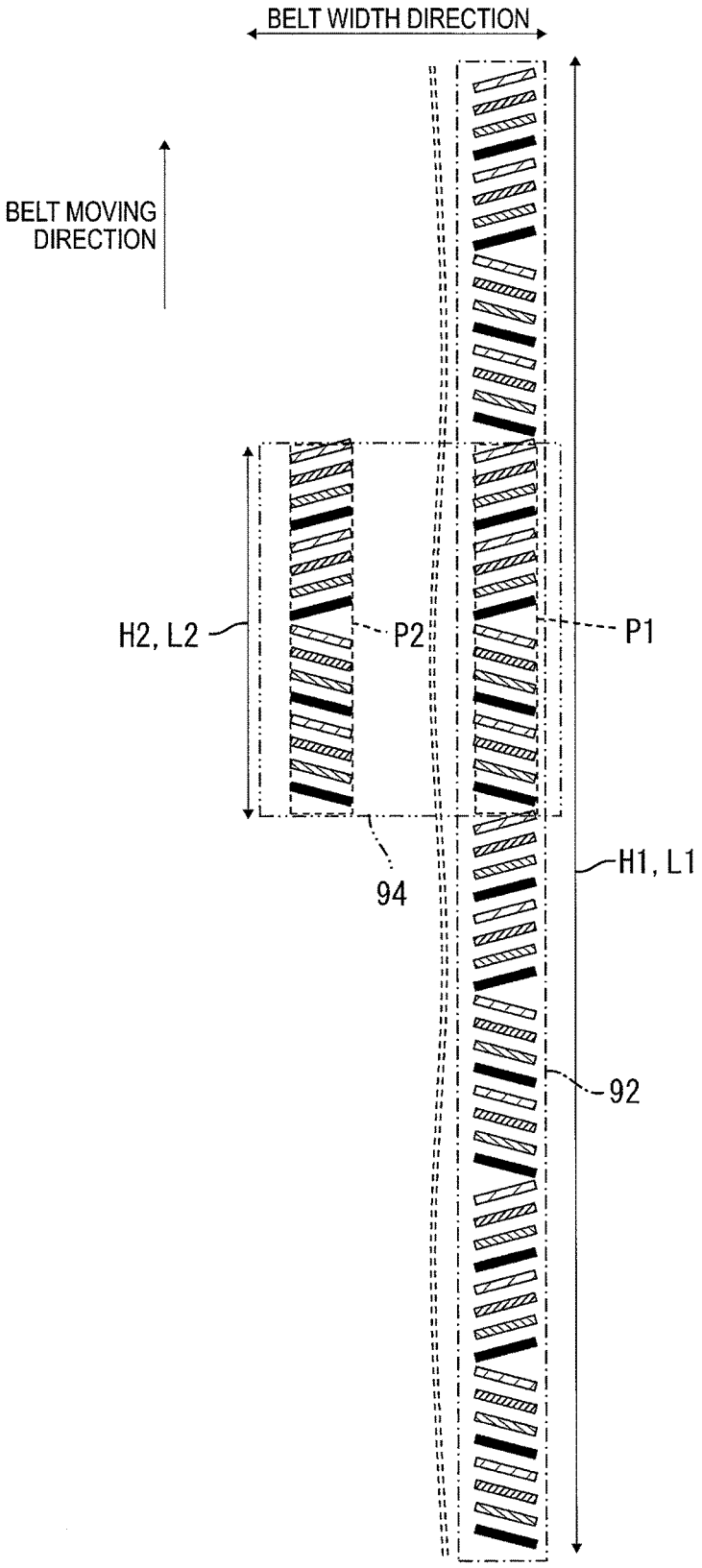
FIG. 11 illustrates a modified example of the mark groups of the pattern A.
Figure 12:
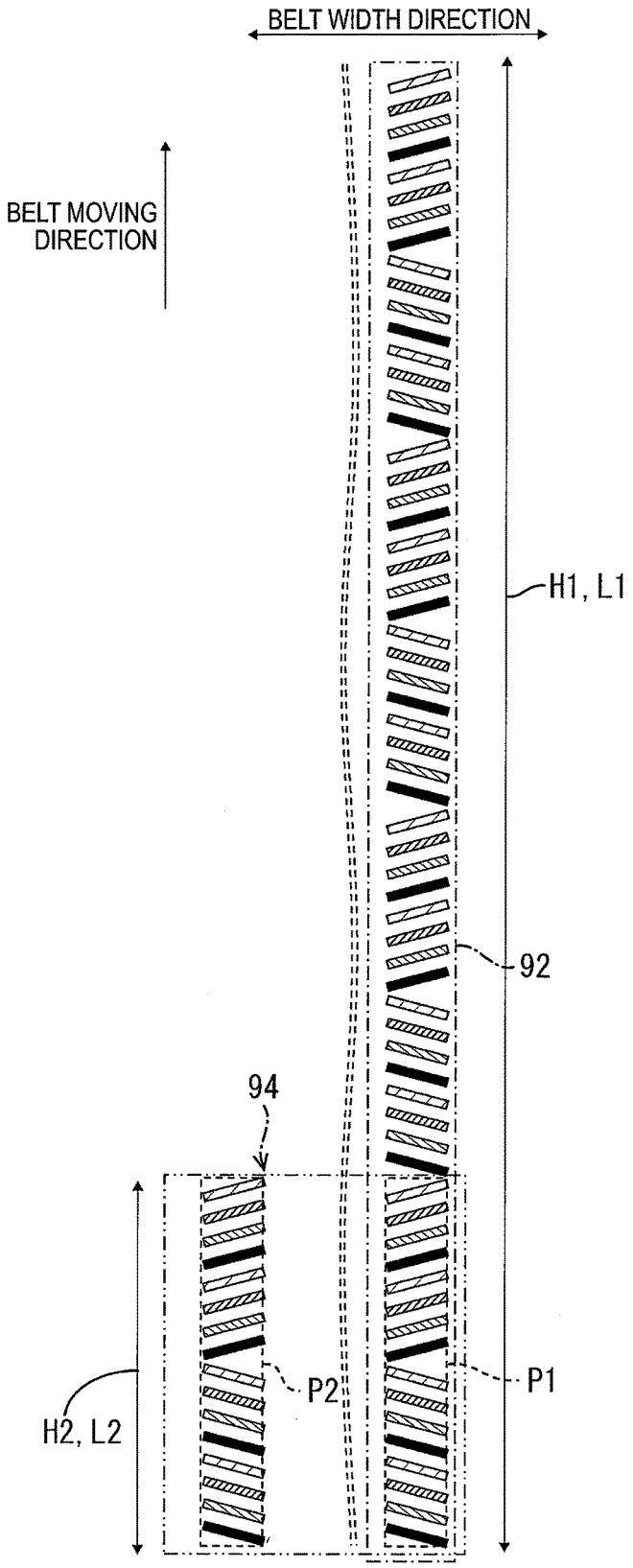
FIG. 12 illustrates another modified example of the mark groups of the pattern A.

As illustrated in FIG. 11, the first patch P1 may be one of the patches P included in the first mark group 92 that is the second one from the downstream side in the belt moving direction. As illustrated in FIG. 12, the first patch P1 may be one of the patches P included in the first mark group 92 that is provided on the most upstream side in the belt moving direction. In each of the cases of FIGS. 11 and 12, the second patch P2 may be provided to be away from the first patch P1 in the belt width direction.

(4) In the above illustrative aspects, the printer 10 includes one CPU 62 that executes various processes. However, it is not limited thereto. For example, the printer 10 includes a plurality of CPUs and ASICs each of which executes each process.

(5) The program that is executed by the CPU 62 is not necessarily stored in the memory 64 but may be stored in the CPU 62 or any other storing devices.

What is claimed is:

1. An image forming apparatus comprising:

an image forming device configured to form images with an image forming agent on a print object;

a print object moving device configured to move the print object in a moving direction relative to the image forming device;

a detector configured to detect the images; and a control device configured to:

control the image forming device to form a first mark group and a second mark group on the print object;

control the detector to detect the first mark group and the second mark group on the print object;

execute a correction process based on the detection of the first mark group and the second mark group, the correction process comprising:

determining moving direction deviation in image forming positions in the moving direction based on the detection of the first mark group, and determining width direction deviation in image forming positions in the width direction based on the detection of the second mark group;

control the image forming device to form the first mark group and the second mark group corresponding to a part of the first mark group and determine the width direction deviation based on the detection of the first mark group and the detection of the second mark group, and then determine the moving direction deviation based on a first detection result;

determine a width and a position of a density detection mark based on the determined width direction deviation; and control the image forming device to form a density detection mark based on the determined width and position;

wherein the first mark group includes a first set of multiple patches and a second set of multiple patches sequentially aligned in the moving direction in a single column, wherein the second mark group includes the first set of multiple patches and a third set of multiple patches, the third set of multiple patches being arranged away from the first set of multiple patches and away from the single column of the first mark group in a width direction perpendicular to the moving direction, wherein the first set of multiple patches includes at least one yellow patch, at least one magenta patch, at least one cyan patch, and at least one black patch, all arranged in a particular order, wherein the second set of multiple patches includes at least one yellow patch, at least one magenta patch, at least one cyan patch, and at least one black patch, all arranged in the particular order, wherein the third set of multiple patches includes at least one yellow patch, at least one magenta patch, at least one cyan patch, and at least one black patch, all arranged in the particular order, wherein the print object, outward of the first mark group in the width direction, is free of any additional marks before and after the third set of multiple patches in the moving direction, and wherein a number of patches included in the first mark group is larger than a number of patches included in the third set of multiple patches.

2. An image forming apparatus comprising:

an image forming device configured to form images with an image forming agent on a print object;

a print object moving device configured to move the print object in a moving direction relative to the image forming device;

a detector configured to detect the images; and a control device configured to:

control the image forming device to form a first mark group and a second mark group on the print object;

control the detector to detect the first mark group and the second mark group on the print object;

execute a correction process based on the detection of the first mark group and the second mark group, the correction process comprising:

determining moving direction deviation in image forming positions in the moving direction based on the detection of the first mark group, and determining width direction deviation in image forming positions in the width direction based on the detection of the second mark group;

determine if the determined moving direction deviation is smaller than a predetermined moving direction deviation; and reduce a number of the first mark group or the second mark group if it is determined that the determined moving direction deviation is smaller than the predetermined moving direction deviation;

wherein the first mark group includes a plurality of first patches sequentially aligned in the moving direction, each first patch comprising a plurality of marks arranged along the moving direction; and wherein the second mark group is formed on the print object based on the determined moving direction deviation and includes one of the plurality of first patches of the first mark group and a second patch, the second patch being identical to the one of the plurality of first patches and being arranged away from the one of the plurality of first patches in a width direction perpendicular to the moving direction, wherein the print object, outward of the first mark group in the width direction, is free of any additional marks before and after the second patch in the moving direction, and wherein the control device controls the image forming device to form a density detection mark corresponding to a part of the first mark group prior to forming the second mark group and to form the second mark group based on detection of the density detection mark.

3. An image forming apparatus comprising:

an image forming device configured to form images with an image forming agent on a print object;

a print object moving device configured to move the print object in a moving direction relative to the image forming device;

a detector configured to detect the images;

a control device configured to:

control the image forming device to form a first mark group and a second mark group on the print object;

control the detector to detect the first mark group and the second mark group on the print object; and execute a correction process based on the detection of the first mark group and the second mark group, the correction process comprising:

determining moving direction deviation in image forming positions in the moving direction based on the detection of the first mark group, and determining width direction deviation in image forming positions in the width direction based on the detection of the second mark group;

wherein the first mark group includes a first set of multiple patches and a second set of multiple patches sequentially aligned in the moving direction in a single column, wherein the second mark group includes the first set of multiple patches and a third set of multiple patches, the third set of multiple patches being arranged away from the first set of multiple patches and away from the single column of the first mark group in a width direction perpendicular to the moving direction, wherein the first set of multiple patches includes at least one yellow patch, at least one magenta patch, at least one cyan patch, and at least one black patch, all arranged in a particular order, wherein the second set of multiple patches includes at least one yellow patch, at least one magenta patch, at least one cyan patch, and at least one black patch, all arranged in the particular order, wherein the third set of multiple patches includes at least one yellow patch, at least one magenta patch, at least one cyan patch, and at least one black patch, all arranged in the particular order, wherein the print object, outward of the first mark group in the width direction, is free of any additional marks before and after the third set of multiple patches in the moving direction, and wherein a number of patches included in the first mark group is larger than a number of patches included in the third set of multiple patches; and a measurement device configured to measure one of temperature and humidity, wherein the control device is further configured to:

determine a change value of temperature or humidity based on a previous measured value and a current measured value;

determine if the change value is greater than a threshold value; and control the image forming device to form a density detection mark prior to forming the second mark group if determining that the change value is greater than the threshold value.

4. The image forming apparatus according to claim 3, wherein the image forming device includes a plurality of forming devices configured to form a color image, and the control device is further configured to:

determine if the change value is greater than a threshold value that is set for each of the forming devices; and control a corresponding one of the forming devices to form a density detection mark after forming the second mark group if determining that the change value is equal to or smaller than the threshold value.

5. The image forming apparatus according to claim 4, wherein the control device is further configured to:

control the corresponding image forming device to form the second mark group based on a detection result of the density detection mark that is formed prior to the second mark group; and determine a width and a position of the density detection mark that is to be formed after the second mark group based on the detection of the second mark group.

* * * * *